United States Patent [19]

Yang

[11] Patent Number: 4,592,834

[45] Date of Patent: Jun. 3, 1986

[54] COLUMN FROTH FLOTATION

[75] Inventor: David C. Yang, Houghton, Mich.

[73] Assignee: Board of Control of Michigan Technological University, Houghton, Mich.

[21] Appl. No.: 732,902

[22] Filed: May 9, 1985

Related U.S. Application Data

[63] Continuation of Ser. No. 504,793, Jun. 16, 1983, abandoned.

[51] Int. Cl.[4] ..... B03D 1/02

[52] U.S. Cl. ..... 209/166; 209/170; 261/123

[58] Field of Search ..... 209/166, 168–170; 261/97, 112, 123

[56] References Cited

U.S. PATENT DOCUMENTS

| | | | |
|---|---|---|---|
| 1,167,835 | 1/1916 | Norris | 209/170 |
| 1,809,646 | 6/1931 | Sperr | 261/97 |
| 2,803,528 | 8/1957 | Erdmann | 261/98 |
| 3,330,741 | 7/1967 | Thelig | 261/97 |
| 3,339,730 | 9/1967 | Boutin et al. | 209/168 |
| 3,371,779 | 3/1968 | Hollingsworth et al. | 209/166 |
| 3,450,393 | 6/1969 | Munters | 261/112 |
| 3,862,280 | 1/1975 | Polovina. | 261/112 |
| 4,066,540 | 1/1978 | Wada et al. | 210/221.2 |
| 4,132,635 | 1/1979 | Yang | 209/166 |
| 4,139,584 | 2/1979 | Holmberg | 261/112 |
| 4,303,600 | 12/1981 | Roe | 261/112 |

FOREIGN PATENT DOCUMENTS

| | | | |
|---|---|---|---|
| 680576 | 2/1964 | Canada | 196/11 |
| 694547 | 9/1964 | Canada | 361/2 |
| 700747 | 12/1953 | United Kingdom | 261/98 |
| 1399614 | 7/1975 | United Kingdom | 209/4 |
| 310683 | 4/1972 | U.S.S.R. | 209/170 |

OTHER PUBLICATIONS

Gradient Column Improves Ore Floatation, in Canadian Chemical Processing 2–65, pp. 55–58.

Floatation Column Due for Mill Scale Tests, EM&J, vol. 166, No. 1, pp. 76–83.

Floatation Machines Mining Magazine, 1–82, pp. 35–59.

G. I. Mathieu, "Comparison of Flotation Column with Convention of a Molybdenum Ore" (CIM Bulletin, May, 1972), pp. 41 through 45.

D. A. Wheeler, "Big Flotation Column Mill Tested" E/MJ—Nov. 1966, pp. 98 through 100 and 193.

*Primary Examiner*—Bernard Nozick

[57] ABSTRACT

The froth flotation device includes a flotation column partially filled with a packing which defines a large number of small flow passages extending in a circuitous pattern between the upper and lower portions of the column. A conditioned aqueous pulp of a mineral ore, such as iron ore, is introduced into the midzone of the column. A pressurized inert gas, such as air, is introduced into the bottom of the column and is forced upwardly through the flow passages in the packing. As the air flows upwardly through these flow passages, it is broken into fine bubbles which intimately contact the floatable particles (e.g., iron oxide) in the aqueous pulp and forms a froth concentrate or float fraction which overflows from the top of the column. Wash water is introduced into the top of the column and flows through the flow passages in the packing countercurrently to the float fraction to scrub entrained non-floatable particles (e.g., gangue) from the froth concentrate. A tailing fraction containing the non-floatable particles is withdrawn from the bottom of the column.

13 Claims, 2 Drawing Figures

COLUMN FROTH FLOTATION

BACKGROUND OF THE INVENTION

This invention relates to froth flotation and, more particularly, to column froth flotation for beneficiating mineral ores and the like.

Froth flotation has been used to beneficiate a variety of mineral ores and to effect separation of various other materials for many years. Froth flotation involves the separation of particles from each other in a liquid pulp based on differences in hydrophobicity. The pulp is aerated by introducing a plurality of minute air bubbles into it. The air bubbles tend to attach to the floatable (hydrophobic) particles and cause those particles to rise to the surface as a froth product which overflows from the flotation device, leaving behind the non-floatable (hydrophilic) particles.

An article entitled "Flotation Machines" in *Mining Magazine,* January, 1982, page 35, describes several different types of flotation devices and processes used for beneficiating minerals. In so-called column flotation, a conditioned pulp is introduced into the midzone of a relatively tall column. pressurized air is introduced through a diffuser in the bottom of the column, and wash water is fed into the top of the column. A fraction containing the floatable particles, usually the mineral values, overflows from the top of the column and a fraction containing the non-floatable particles, usually the gangue, is discharged from the bottom of the column by gravity or a pump. Examples of prior column flotation devices and processes are described in Canadian Pat. Nos. 680,576 and 694,547, *Canadian Chemical Processing,* February, 1965, pages 55–58, and *E & MJ,* Volume 66 No. 1, pages 76–78, 83.

The air diffusers in flotation columns have a tendency to become plugged, particularly when a lime depressant is used causing an uneven distribution of air throughout the pulp. Also the small air bubbles generated at the bottom of the column tend to enlarge as they rise toward the top due to a change in static pressure within the column, resulting in a reduced surface contact between the air and particles. Several different approaches have been used to alleviate this problem, including the use of hydrophobic materials and, instead of using a diffuser, introducing the air as a fine dispersion in water. The latter approach is disclosed in U.S. Pat. No. 3,371,779.

SUMMARY OF THE INVENTION

An object of the invention is to provide a simple, economical froth flotation device and process capable of separating floatable particles from an aqueous pulp of a mixture of floatable and non-floatable particles with a minimum number of flotation stages.

Another object of the invention is to provide a froth flotation device and process which produces increased air-to-particle contact.

A further object of the invention is to provide a froth flotation device and process which requires minimal amounts of water and energy.

A still further object of the invention is to provide a froth flotation column which does not reguire an air diffuser having a tendency to become plugged during operation.

Other objects, aspects and advantages of the invention will become apparent to those skilled in art upon reviewing the following detailed description, the drawing and the appended claims.

The invention provides a froth flotation device including a tubular flotation column, packing means disposed in the column defining a large number of small flow passages extending in a circuitous pattern between the upper and lower portions of the column, pulp feed means for introducing an aqueous pulp into the column at an intermediate location for flow through the flow passages, means for introducing wash water into the upper portion of the column for downward flow through the flow passages, means for introducing a pressurized inert gas into the lower portion of the column for upward flow through the flow passages, means for discharging a froth fraction containing floated particles of the aqueous pulp from the upper portion of the column, and means for discharging a tailing fraction containing unfloated particles of the aqueous pulp from the lower portion of the column.

An aqueous pulp containing a mixture of floatable and non-floatable particles is introduced into a column. The inert gas, preferably air, is broken into fine bubbles as it is forced upwardly through the flow passages in the packing. These bubbles intimately contact the floatable particles and form a froth concentrate or float fraction which contains the floatable particles and overflows from the top portion of the column. The wash water, flowing through the flow passages in the packing countercurrently to the float fraction, removes entrained non-floatable particles from the float fraction and a tailing fraction containing the non-floatable particles is withdrawn from the bottom of the column.

In one embodiment, the packing comprises a plurality of vertically extending plates and spacer means for laterally spacing the plates apart to define a plurality of small flow passages between adjacent plates. The spacer means can comprise rows of corrugations on each of the plates, preferably extending diagonally relative to the horizontal.

In one embodiment, separate, vertically adjacent sections of the plates are provided. These sections preferably are oriented so that the vertical planes of the plates in one section are angularly related to the vertical planes of the plates in the adjacent section.

DESCRIPTION OF THE PREFERRED EMBODIMENT

Figure 1:
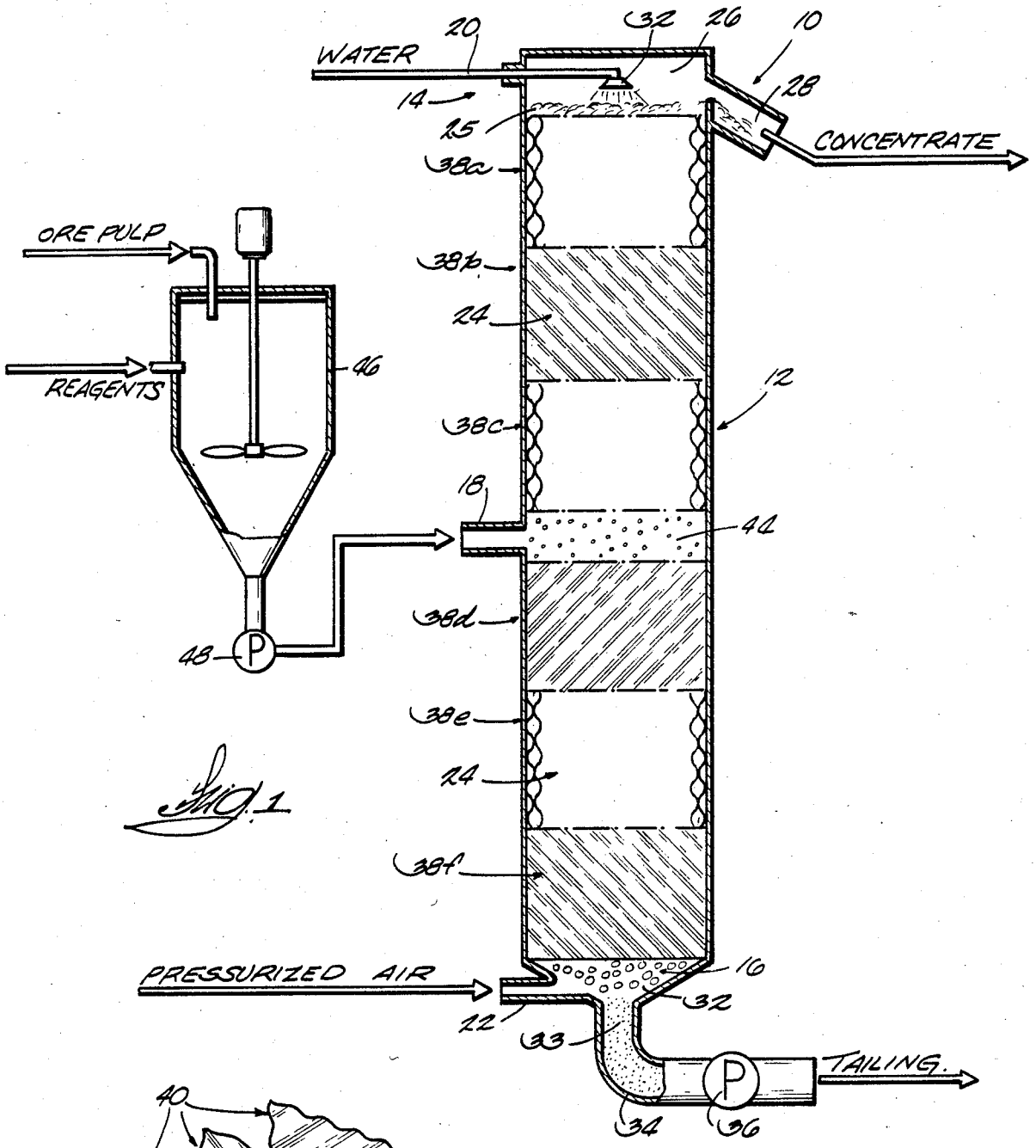
FIG. 1 is a schematic representation of a froth flotation column embodying the invention.

The column flotation device and process of the invention can be used to separate a wide variety of materials in a broad range of particle sizes. It is particularly adaptable for separation of mineral values from the gangue in fine-grained ores, such as low-grade, oxidized taconite ores from the Lake Superior area. The invention will be described in connection with that application.

The flotation device 10 provided by the invention includes a tubular column 12 having an upper portion 14 and a lower portion 16, a pulp inlet 18 for introducing a conditioned aqueous slurry or pulp of an oxidized taconite ore into the column at an intermediate location, a water inlet 20 for introducing wash water into the upper portion of the column 12, and a gas inlet 22 for introducing a pressurized gas, such as air, into the lower portion 16 of the column 12.

The column 12 can be generally upright or vertical as illustrated in FIG. 1 or inclined at angle to the vertical. The column 12 is partially filled with a packing 24 which defines a large number of small flow passages extending in a circuitous or tortuous pattern between the upper and lower portions 14 and 16. Wash water introduced into the upper portion 14 of the column 12 through the water inlet 20 flows downwardly through these flow passages. Pressurized air introduced into the lower portion 16 of the column 12 through the gas inlet 22 is forced upwardly through these flow passages, countercurrently to the wash water and the portion of the aqueous pulp descending through these flow passages.

As the air passes upwardly through these flow passages, it is broken into fine bubbles of relatively uniform size. These rising bubbles intimately contact the particles of the aqueous pulp in the flow passages of the packing 24 to produce a froth concentrate or float fraction containing primarily the floatable particles and a minor amount of essentially non-floatable particles entrained in the froth. The air bubbles carry the froth concentrate 25 upwardly into a froth compartment 26 in the upper portion of the column 12. The froth concentrate 25 is discharged from the froth chamber 26 by overflowing therefrom through an outlet 28.

Wash water descending through the flow passages in the packing 24 induces entrained non-floatable particles to separate from the froth concentrate and drop by gravity (i.e., sink) through these flow passages. While the wash water can be introduced into the column 12 in any convenient manner, it preferably is introduced into the froth chamber 26 and above the top surface of the froth concentrate 26 through a spray nozzle 32 centrally disposed in the top of the column 12. The spray nozzle 32 distributes multiple streams of water over the froth in the froth chamber 26, thereby insuring a more uniform contact of the wash water with non-floatable particles in the froth concentrate 25 and also a more uniform distribution of the wash water through the flow passages in the packing 24.

A tailing fraction 33 containing the non-floatable particles in the aqueous pulp collects in a tailing chamber 32 at the bottom of the column 12 and is discharged therefrom through an outlet 34. Although not particularly critical, the tailing chamber 32 preferably is conically shaped as illustrated in FIG. 1 to promote discharge of the tailing fraction. The tailing fraction preferably is withdrawn through the outlet 34 by a conventional variable flow pump 36.

While the column 12 can have various cross-sectional configurations, in the specific construction illustrated, it has a square cross section. The cross sectional dimensions and length of the column 12 are governed by the type of aqueous pulp being treated, the particular type of packing used, the desired throughput, and other variables familiar to those skilled in the art.

The packing 24 can be in a variety of different forms capable of providing a substantially plugged flow condition and defining a large number of flow passages extending in a circuitous or tortuous pattern between the upper and lower portions of the column 12. These flow passages cause the air bubbles to break up and combine into fine bubbles of relatively uniform size, thereby maximizing intimate surface area contact with the floatable particles. Suitable packing includes conventional packing materials used in packed tower for vapor-liquid transfer operations, such as Raschig rings, Berl saddles, partition rings, and the like.

In the preferred embodiment illustrated, the packing 24 consists of a plurality of sections **38*a*–38*f* of vertical extending plates 40. Each section includes a plurality of the plates 40 and spacer means for laterally spacing the plates 40 apart to define a plurality of relatively small flow passages between adjacent plates 40. In the specific construction illustrated, such spacer means comprises uniformly spaced rows of corrugations 42 on each plate 40. The corrugations 42 preferably extend diagonally, e.g., at an angle of approximately 45° to the horizontal, to eliminate vertical flow passages of substantial length. The angular orientation of the corrugations can be varied to control flow through the flow passage. For instance, this flow can be increased by increasing the angle of the corrugations 42** to the horizontal.

Figure 2:
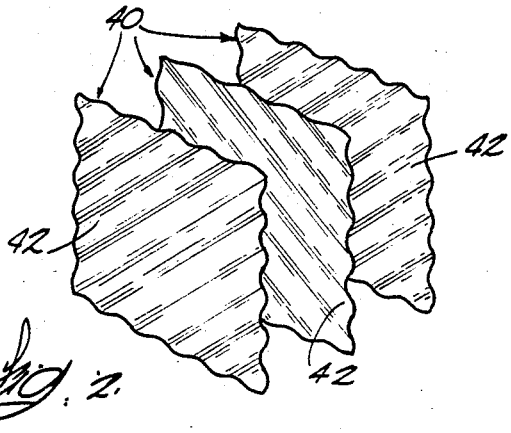
FIG. 2 is an exploded, perspective view of a portion of the corrugated plates making up one section of packing for the column illustrated in FIG. 1.

In order to further enhance the circuitous or tortuous pattern of the flow passages defined between adjacent plates 40, the corrugations 42 of alternate plates 40 preferably extend in the opposite direction as illustrated in FIG. 2. That is, the corrugations on one plate extend at an angle to the corrugations on the next plate. Also, alternate sections are positioned so that the vertical planes of the plates in one section are angularly related (e.g., at about 90°) to the vertical planes of the plates in the adjacent section. Referring to FIG. 1, the vertical planes of the plates 40 in sections **38*a*, 38*c*, and 38*e* extend perpendicularly to the plane of the page and the vertical planes of the plates in sections 38*b*, 38*d* and 38*f*** extend parallel to the plane of the page.

The packing sections **38*c* and 38*d* in the vicinity of the pulp inlet 38 preferably are spaced apart to provide a substantially unobstructed feed compartment or chamber 44. The packing sections 38*a*, 38*b*, and 38*c* above the feed chamber 44 make up the primary cleaning section of the column 12 and the packing sections 38*d*, 38*e* and 38*f* below the feed chamber 44** make up a scavenging section wherein the floatable particles are separated from the descending tailings.

In a typical operation, an iron ore, such as oxidized taconite, is comminuted into a particle size suitable for liberation of the mineral values and for froth flotation. An aqueous slurry or pulp of the particles is introduced into a stirred conditioning vessel 46 for the addition and admixing of suitable flotation reagents. If silica or gangue is to be floated (reverse flotation), a cationic collector or an anionic collector (for calcium activated silica) is added to and mixed with the aqueous pulp in the conditioning vessel 46. If iron oxide is to be floated, a suitable anionic collector, such as a fatty acid type collector, is added to and thoroughly mixed with the aqueous pulp in the conditioning vessel 46.

Various suitable conditioning reagents can be used depending primarily on the material being treated and the type of flotation. The conditioning reagent disclosed in U.S. Pat. No. 4,132,635, which patent is incorporated herein by reference, is particularly effective for iron ores when an anionic collector is used. That conditioning reagent is formed by mixing a polyvalent metal salt with an alkali metal silicate. The conditioning reagent is usually added to and thoroughly mixed with the pulp prior to the addition of the collector. After the collector has been added to the conditioning vessel 46, the pulp is mixed for a sufficient time to insure uniform dispersion of the collector throughout the pulp.

In some cases, it may be necessary to add a small amount of fuel oil and/or a conventional frothing agent to the pulp. When used, the frothing agent can be incorporated into the pulp before, after, or together with the collector. If the frothing agent is added separately, the pulp is mixed for a sufficient time to insure uniform dispersion of the frothing agent throughout the pulp.

Following conditioning, the pulp is withdrawn from the conditioning vessel 46 by a pump 48 and introduced into the column through the pulp inlet 18.

The flow rates of the ore pulp, the air and the wash water can be adjusted to obtain a material balance which provides the most effective separation of the floatable particles (e.g., iron oxide) from the non-floatable particles (e.g., gangue).

The device and process of the invention have several advantages over conventional flotation devices and processes. They provide all the advantages of conventional flotation columns and further provide increased air-to-particle contact, eliminate the need for a special device in the bottom of the column for generating fine air bubbles, and require less water and energy. More importantly, floatable particles, such as iron oxide, can be more effectively separated from non-floatable particles, such as gangue, with single stage flotation. That is, a conventional flotation column usually requires at least two flotation stages to recover the same amount of iron oxide from a low grade iron ore.

In addition to being used for single stage flotation, the device of the invention can be used in combination with conventional flotation machines and two or more can be used in series.

The following examples are presented to illustrate the invention and are not to be construed as limitations thereof.

EXAMPLE 1

A series of laboratory tests were run on an experimental column consisting of a 2-inch I.D. tube, 8 feet long and almost entirely packed with 2-inch long conventional brass tower packing cylinders.

Samples of −10 mesh oxidized taconite ore (obtained from the Cascade deposit owned by Cleveland-Cliffs Iron Company) were ground batchwise at 60 weight % solids in a rod mill in the presence of water for about 20 minutes to produce a slurry or pulp of about 80 weight % passing 500 mesh. The pulp was conditioned with a conditioning reagent prepared in accordance with U.S. Pat. No. 4,132,635 and the pH was adjusted to 8.8 by adding soda or sulfuric acid. The resulting pulp samples were separately introduced into a stirred container where a fatty acid collector (PAMAK-4), No. 2 fuel oil, and a frothing agent were added and mixed into the pulp.

The conditioned pulp samples containing 20% solids were continuously pumped from the stirred container into the mid-section of the column at a rate of about 130 cc/min. Water was introduced near the top of the column at a flow rate of about 50 cc/min. and air was introduced near the bottom of the column at a flow rate of about 8 l/min.

Samples of the concentrate and tailings, respectively taken from the top and bottom of the column, were collected and analyzed for iron content. Results from the representative tests are summarized in Table I.

These results demonstrate the superior separation efficiency of a flotation column arranged and operated in accordance with the invention, even though only a single flotation stage is employed.

EXAMPLE 2

A series of pilot plant tests were run on a column arranged generally in the manner illustrated in FIG. 1 and a conventional 8-stage WEMCO Fagergren flotation machine. The column was 20 feet tall, had a 7¼ in.×7¼ in. square cross section, and included six 3-foot sections of packing plates. Each packing section was packed with 5 layers of corrugated plates. The plate corrugations were ⅛ inch high and extended at about 45° to the horizontal, and alternate layers or sections were oriented at 90° to each other.

An oxidized taconite ore was ground to about 75% −500 mesh and formed into a pulp. A conditioning reagent prepared in accordance with U.S. Pat. No. 4,132,635, an anionic collector (PAMAK-4), and No. 2 fuel oil were mixed into the pulp. One stream of the conditioned pulp containing about 20 weight % solids was pumped into the feed compartment of the column at a feed rate of about 150 lbs/hr and another stream of the same pulp was processed in the conventional flotation machine. Air at a pressure of about 10–12 psig was introduced into a column through the gas inlet at a rate of about 300–500 $ft^3$/hr and wash water was sprayed into the froth chamber at a rate of about 30–50 gal/hr.

Samples of the froth concentrate and tailings from the column and the conventional flotation machine were collected and analyzed for iron content. The results from these tests are summarized in Table II. Under the "Machine Used" heading in Table II, "A" designates the device of the invention and "B" designates the conventional flotation machine.

From these results, it can be seen that single stage flotation with a column and process of the invention produces higher grade concentrates and/or higher recoveries than eight stages of a conventional flotation machine.

TABLE I

IRON RECOVERED FROM LOW GRADE ORES (LABORATORY)

| | Head | Concentrate | | | Tailings | | |
|---|---|---|---|---|---|---|---|
| Run No. | Assay, % Fe | Wt. % | % Fe | % Fe Distrib. | Wt. % | % Fe | % Fe Distrib. |
| 1 | 35.5 | 44.4 | 65.9 | 82.4 | 55.6 | 11.2 | 17.6 |
| 2 | 35.3 | 46.8 | 64.1 | 84.9 | 53.2 | 10.0 | 15.1 |
| 3 | 35.4 | 43.5 | 66.4 | 81.5 | 56.5 | 11.6 | 18.5 |
| 4 | 35.4 | 42.6 | 67.2 | 80.7 | 57.4 | 11.9 | 19.3 |

TABLE II

COMPARISON OF IRON RECOVERED FROM TACONITE INVENTION (PILOT PLANT) vs. CONVENTIONAL FLOTATION MACHINE

| | | | Concentrate | | | Tailings | | |
|---|---|---|---|---|---|---|---|---|
| Run No. | Machine Used | Head Assay, % Fe | Wt. % | % Fe | % Fe Distrib. | Wt. % | % Fe | % Fe Distrib. |
| 1 | A | 35.7 | 43.3 | 67.0 | 81.3 | 56.7 | 11.8 | 18.7 |
| | B | 35.7 | 48.3 | 61.9 | 83.8 | 51.7 | 11.2 | 16.2 |
| 2 | A | 35.6 | 28.9 | 67.6 | 53.7 | 71.1 | 23.7 | 46.3 |

TABLE II-continued

COMPARISON OF IRON RECOVERED FROM TACONITE INVENTION (PILOT PLANT) vs. CONVENTIONAL FLOTATION MACHINE

| Run No. | Machine Used | Head Assay, % Fe | Concentrate Wt. % | Concentrate % Fe | Concentrate % Fe Distrib. | Tailings Wt. % | Tailings % Fe | Tailings % Fe Distrib. |
|---|---|---|---|---|---|---|---|---|
| | B | 35.6 | 25.5 | 66.8 | 46.8 | 74.5 | 26.0 | 53.2 |
| 3 | A | 35.5 | 49.0 | 62.8 | 86.7 | 51.0 | 9.3 | 13.3 |
| | B | 35.5 | 45.3 | 62.5 | 79.8 | 54.7 | 13.1 | 20.2 |
| 4 | A | 35.4 | 46.6 | 64.7 | 85.2 | 53.4 | 9.8 | 14.8 |
| | B | 35.4 | 43.0 | 63.8 | 77.5 | 57.0 | 14.0 | 22.5 |
| 5 | A | 35.7 | 45.1 | 65.5 | 82.8 | 54.9 | 11.2 | 17.2 |
| | B | 35.7 | 41.0 | 65.0 | 74.7 | 59.0 | 15.3 | 25.3 |
| 6 | A | 35.2 | 46.9 | 64.1 | 85.4 | 53.1 | 9.7 | 14.6 |
| | B | 35.2 | 41.0 | 64.5 | 75.2 | 59.0 | 14.8 | 24.8 |

From the foregoing description, one skilled in the art can easily ascertain the essential characteristics of the invention, and without departing from the spirit and scope thereof, make various modifications and changes to adapt it to various usages and conditions.

I claim:

1. A device for concentrating by froth flotation a floatable material in an aqueous pulp containing a mixture of floatable and non-floatable particles, said device comprising a tubular flotation column having an upper portion including a primary cleaning zone, a lower portion including a scavenging zone, and an intermediate portion including a pulp inlet zone between said cleaning and scavenging zones;

packing means disposed in said cleaning and scavenging zones and defining a large number of small flow passages extending in a circuitous pattern through the respective zone;

pulp forming means for forming an aqueous pulp containing the floatable and non-floatable particles;

pulp feed means for introducing the aqueous pulp from said pulp forming means into said pulp inlet zone for flow through said flow passages;

means for introducing wash water into said upper portion of said column above said cleaning zone for downward flow through said flow passages;

means for introducing a pressurized inert gas into said lower portion of said column below said scavenging zone for upward flow through said flow passages, whereby the gas, as it flows upwardly through said flow passages, is broken into fine bubbles which intimately contact the particles of the aqueous pulp in said flow passages;

means for discharging a float fraction containing floated particles of the aqueous pulp from the upper portion of said column above said cleaning zone; and means for discharging a tailing fraction containing non-floated particles of the aqueous pulp from the lower portion of said column below said scavenging zone.

2. A device according to claim 1 wherein said packing means comprises a plurality of vertically extending plates; and spacer means for laterally spacing said plates apart to define a plurality of flow passages between adjacent plates.

3. A device according to claim 2 including a plurality of vertically adjacent, separate sections of said plates.

4. A device according to claim 3 wherein said sections are oriented so that the vertical planes of the plates in each of said sections are angularly related to the vertical planes of the plates in the adjacent section.

5. A device according to claim 3 wherein said spacer means comprises rows of corrugations on each of said plates extending diagonally relative to the horizontal.

6. A device according to claim 5 wherein the corrugations of adjacent plates extend in opposite directions.

7. A process for concentrating by froth flotation a floatable material in an aqueous pulp containing a mixture of floatable and non-floatable particles, said process including the steps of providing a generally tubular flotation column having an upper portion including a cleaning zone, a lower portion including a scavenging zone, and an intermediate portion including a pulp inlet zone between said cleaning and scavenging zones;

providing in said cleaning and scavenging zones packing means defining a large number of flow passages extending n a circuitous pattern through the respective zone;

preparing the aqueous pulp for flotation separation of the particles of the aqueous pulp;

introducing the resulting pulp into the pulp inlet zone for flow through the flow passages of the packing means;

introducing wash water into the upper portion of the column for downward flow through the flow passages of the packing means;

introducing a pressurized inert gas into the lower portion of the column for upward flow through the flow passages of the packing means, whereby the gas is broken into fine bubbles which intimately contact the particles of the aqueous pulp in the flow passages of the packing means;

withdrawing a float fraction containing the floated particles of the aqueous pulp from the upper portion of said column above the cleaning zone; and withdrawing a tailing fraction containing non-floated particles of the aqueous pulp from the lower portion of the column below the scavenging zone.

8. A process according to claim 7 wherein the pulp contains a mineral ore including a mixture of mineral value particles and gangue particles; and the pulp is prepared for flotation by treating with flotation reagents which are effective for promoting separation of the mineral value and the gangue by flotation.

9. A process according to claim 8 wherein said mineral ore is a low-grade iron ore.

10. A process according to claim 7 wherein the packing comprises a plurality of separate, vertically adjacent sections of vertically extending plates; and spacer means for laterally spacing said plates apart to define a plurality of flow passages between adjacent plates.

11. A process according to claim 10 wherein said sections are oriented so that the vertical planes of the plates in one section is angularly related to the vertical planes of the plates in the adjacent section.

12. A process according to claim 10 wherein the spacer means comprises rows of corrugations on each of the plates extending diagonally relative to the horizontal.

13. A process according to claim 12 wherein the corrugations of adjacent plates extend in opposite directions.

* * * * *